United States Patent [19]

Skach, Jr. et al.

[11] Patent Number: 5,015,291

[45] Date of Patent: May 14, 1991

[54] PROCESS FOR DESULFURIZATION OF MOLTEN HOT METALS

[75] Inventors: Edward J. Skach, Jr., Freeport, Tex.; Paul S. Frederick, Midland, Mich.

[73] Assignee: The Dow Chemical Company, Midland, Mich.

[21] Appl. No.: 447,983

[22] Filed: Dec. 8, 1989

Related U.S. Application Data

[63] Continuation-in-part of Ser. No. 366,814, Jun. 14, 1989.

[51] Int. Cl.[5] ..... C21C 7/02

[52] U.S. Cl. ..... 75/531

[58] Field of Search ..... 75/58, 51.6, 96

[56] References Cited

U.S. PATENT DOCUMENTS

| | | | |
|---|---|---|---|
| 4,159,906 | 7/1979 | Meichsner | 75/58 |
| 4,214,899 | 7/1980 | Radzilowski | 75/96 |
| 4,409,193 | 10/1983 | Sato | 423/290 |
| 4,420,333 | 12/1983 | Takahashi | 75/58 |
| 4,562,163 | 12/1985 | Endo | 423/290 |

*Primary Examiner*—Peter D. Rosenberg

[57] ABSTRACT

A process for desulfuring molten metal by injecting a desulfurization reagent into the molten metal using a carrier gas via a lance immersed in the molten metal; said desulfurization reagent comprising magnesium nitride.

6 Claims, 1 Drawing Sheet

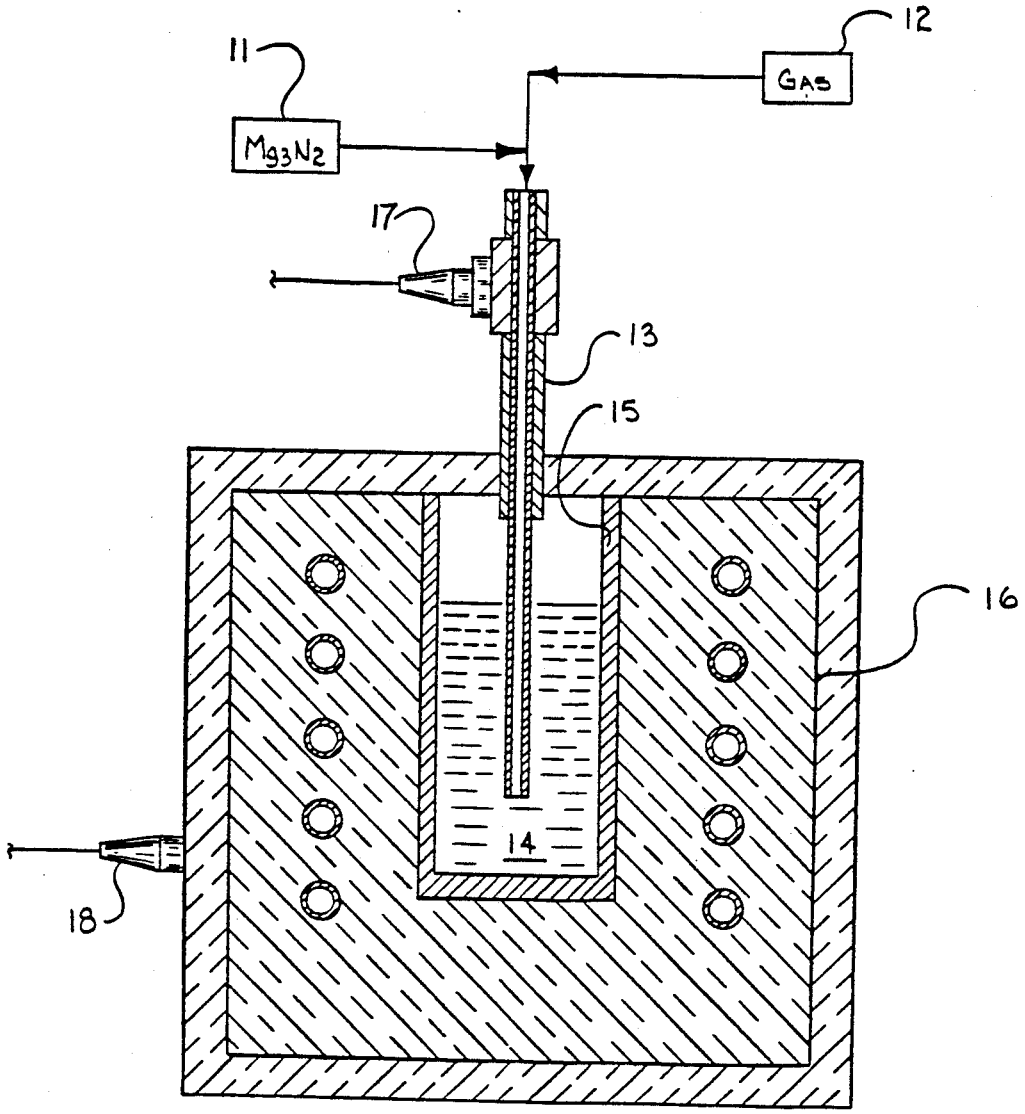
11
$Mg_3N_2$
12
GAS
17
13
15
16
14
18

PROCESS FOR DESULFURIZATION OF MOLTEN HOT METALS

CROSS-REFERENCE TO RELATED APPLICATION

This application is a continuation-in-part of pending application Ser. No. 366,814 filed June 14, 1989.

BACKGROUND OF THE INVENTION

This invention relates to a process for desulfurization of molten metals including injecting a desulfurization reagent into said molten metal, said desulfurization reagent comprising magnesium nitride.

Desulfurization of molten metal by magnesium is well known, for example, in the steel manufacturing process. Generally, magnesium is introduced into the molten hot metal by any of a variety of means, for example, a desulfurization reagent may be added during steel manufacturing through injection lances. Upon injection, the magnesium melts, then vaporizes, and then the vapors dissolve into the molten hot metal. The dissolved magnesium reacts with sulfur present in the molten hot metal and forms magnesium sulfide, an insoluble compound. This insoluble compound has a density less than the density of molten hot metal and, thus, floats to the top of the molten metal and then mixes with the slag that is also floating on top of the liquid metal. The sulfur is removed by removal of the slag layer in a subsequent step. It is also well known that magnesium when injected into steel causes a violent reaction, for example, the addition of magnesium in particulate form, the violent reaction may take place in the form of bubbling, splattering, or the like. Also, finely ground particulate dust is difficult to meter in injection processes and such finely ground dust injectables create a hazard in handling. For example, finely ground particulate when exposed to high temperatures and oxygen may produce an explosion. Such may be the case with handling finely ground magnesium granules injected into a molten hot metal, such as molten steel, normally at process temperatures of up to about 1800 degrees centigrade.

Other known magnesium based injectable materials used as desulfurization reagents include magnesium granules with a surface coating of a second material. For example, U.S. Pat. No. 4,331,711 discloses magnesium or alloys of magnesium particles coated with a salt such as a halide of Na, K, Li, Mg, Ca, Ba, Mn or Sr or mixtures of these salts.

U.S. Pat. No. 4,398,947 discloses a desulfurization reagent including magnesium granules containing a coating of an anti-caking agent consisting of stearates of Mg, Ca and Al.

U.S. Pat. No. 4,401,465 discloses a desulfurization reagent including substantially nonhygroscopic flux coated magnesium granules containing a coating of fluoride-containing salt such as alkali and alkaline earth metal fluorides and fluorborates.

Mixtures of powders of materials such as magnesium and calcium or lime are also known desulfurization reagents. In addition, U.S. Pat. No. 4,705,561 discloses a composite material of a magnesium and calcium oxide useful as a desulfurization reagent.

Another useful material as a desulfurization reagent is disclosed in U.S. Pat. No. 4,708,737 which includes magnesium or aluminum impregnated into an alkaline earth compound.

It would be desirable to provide a magnesium based hot metal desulfurization reagent which is a single reagent, i.e., not a mixture or composite because mixtures may tend to separate. It is also desirable to provide a magnesium based hot metal desulfurization reagent which is easy and safe to handle, has a low injection violence and has a high desulfurization efficiency.

SUMMARY OF THE INVENTION

The present invention relates to a process for desulfurization of molten hot metal or molten steel using magnesium nitride as a desulfurization reagent.

One aspect of the present invention is directed to a process for desulfurizing molten hot metal, by injecting a desulfurization reagent into the molten hot metal using a carrier gas via a lance immersed in the molten hot metal; said desulfurization reagent comprising powdered or particulate magnesium nitride.

Another aspect of the present invention is directed to a desulfurization reagent composition comprising magnesium nitride.

Another aspect of the present invention is directed to a process for desulfurizing molten steel by inserting a desulfurization reagent into the molten steel using a carrier gas via a lance immersed in the molten steel; said desulfurization reagent comprising magnesium nitride.

Another aspect of the present invention is directed to a process for desulfurizing molten steel by inserting a desulfurization reagent into the molten steel using a carrier gas via a lance immersed in the molten steel; said desulfurization reagent comprising a powdered or particulate magnesium nitride.

BRIEF DESCRIPTION OF THE DRAWING

The drawing is a cross-sectional view of an induction furnace used in the present invention as a means for injecting a desulfurization reagent into a molten hot metal.

DETAILED DESCRIPTION OF THE PREFERRED EMBODIMENT(S)

In accordance with the present invention, a hot molten metal in a crucible is injected with magnesium nitride particulate material at a temperature of from about 1300 to about 1800 degrees centigrade. The violence of the injections are measured and compared to violence measurements of other known desulfurization reagents injected into the same crucible. The desulfurization reagent efficiencies of the reagents are measured.

The hot molten metals include, for example, molten iron or steel.

Magnesium nitride may be prepared by well known methods, for example, as disclosed in the following publication: Journal of Applied Chemistry, 1968, Volume 18, March, page 77.

This material can also be obtained commercially in powder form in sizes of from 10 to 50 microns, for example, from Cerac Inc., Milwaukee, Wis.

Preferably, the desulfurization reagent magnesium nitride is purchased as analytical grade magnesium nitride and then prepared by grinding in an argon purged dry box.

Alternatively, magnesium nitride can be easily made by nitridation of magnesium in air at above 400 degrees centigrade in the presence of inorganic oxides for example, by using calcium oxide (CaO) as the catalyst for nitridation.

The carrier gas used to inject the $Mg_3N_2$ into the molten metal may be any dry gas that does not react with the molten hot metal and does not interfere with the reaction of magnesium and sulfur to form MgS. The carrier gas can be, for example, nitrogen, and/or argon.

In carrying out one embodiment of the process of the present invention and with reference to the drawing, an injection reagent such as magnesium nitride 11 is injected into an injection gas stream such as nitrogen 12 which passes through an injection lance 13 into a molten hot metal such as molten steel 14 in a crucible 15. The crucible 15 is in an induction furnace 16. A first sound detector 17 is used to measure the sound of the gas stream 12 through lance 13 and a second sound detector 18 is used to measure the sound of reaction in the crucible 15. Signals are transmitted from the detector 17 and 18 to a recorder (not shown). The crucible with hot molten metal is heated up to the aforementioned preferred temperature of about 1300 degrees centigrade to about 1800 degrees centigrade and the sound vibrations during reactions in the crucible 15 are picked up by the detectors 17 and 18.

EXAMPLE

This example was carried out using a 150 pound capacity molten hot metal Ajax induction melting furnace substantially similar to the one shown in the drawing. The induction power was provided by a TOCCO meltmaster power supply consisting of a 150 kilowatt motor generator providing 3000 CPS AC current to the induction heating coils in the Ajax furnace.

A 2.8 gram sample of magnesium nitride was placed in an injector located above the 150 pound crucible of molten hot metal. Then with nitrogen as the carrier gas at a rate of about 3.36 SCFM, the sample was injected into the molten hot metal through a $\frac{1}{4}$ inch ID ceramic coated steel lance to a depth of 12 inches.

Microphones located in the furnace next to the crucible wall picked up the sound vibrations of the violence of the injections. These sounds were electronically recorded on a strip chart recorder. Some data were integrated on an integrator to determine the level of violence (sound) from each injection.

The data described in Table I was obtained in this example:

TABLE I

REAGENT RELATIVE VIOLENCE COMPUTER INTEGRATED

| Sample | Reagent | TA* (average) | TA-BG** | Rank |
|---|---|---|---|---|
| 1 | Mag-Lime Blend | 449535 | 83720 | 3 |
| 2 | Mg—Al—CaO | 742413 | 376598 | 7 |
| 3 | Pelamag ® | 578140 | 212325 | 6 |
| 4 | Mg—CaO Alloy | 558215 | 192400 | 4 |
| 5 | Calcium Carbide/Mg | 577880 | 212065 | 5 |
| 6 | Mag Nitride | 364365 | −1450 | 2 |
| 7 | Calcium Carbide/Pelamag | 330855 | −34960 | 1 |
| 8 | Lance + Nitrogen (background = BG**) | 365815 | 0 | — |

*TA = Total integrated area under curve
**BG—Background area (Lance + Nitrogen only)
Note: The terms "Mg" and "Mag" refer to magnesium.

Table I lists several reagents tested in a ranking with the least violent having a ranking of 1 and the most violent having a ranking of 7. These data indicated that up to this point the only reagents that had equivalent to or lower violence than the mag lime blend were calcium carbide/Pelamag ® blend and magnesium nitride. The other reagents in Table I that were tested indicated violence levels approaching and even surpassing the violence of Pelamag ®.

TABLE II

REAGENT SULFUR REMOVAL AND RELATIVE VIOLENCE

| Sample | Reagent* | Sulfur Removed** | Violence Observed |
|---|---|---|---|
| 1 | Mag-Lime Blend (10-6.6 gram tests) | .005 | low/variable test to test |
| 2 | Mag Nitride-Mg—CaO (Dow made Mag Nitride) | .0007 | very low |
| 3 | Mag Nitride (purchased) (36 grams @ 80% Mag nitride) | N.M. | none |
| 4 | Mag Nitride-Mg—CaO (Dow made Mag Nitride) | .0025 | low |
| 5 | Mag-Lime Blend (10-6.6 gram tests) | .006 | low/variable test to test |
| 6 | Mag Impregnated Lime (30% Mag) (10-6 gram tests) | .006 | low |
| 7 | Mag Nitride (purchased) (28 grams @ 100% Mag nitride) | .004 | minimal |
| 8 | Mag Impregnated Calcium Carbide (10-6 gram tests) | .009 | low |

*Available magnesium held approximately constant in each sample.
**Average weight percent sulfur removed. Initial sulfur content was the same in each case (approximately .015% by weight).
N.M. = Not Measured.
Note: The terms "Mg" and "Mag" refer to magnesium.

Table II is a summary describing the final data acquisition relating to various desulfurization reagents. It includes relative observation violence measurements and sulfur removal information for magnesium based desulfurization reagents. These data indicate that magnesium nitride is about the same in relative sulfur removal and violence as mag-lime blends.

What is claimed is:

1. A process for desulfurizing molten metal comprising:

injecting a desulfurization reagent into the molten hot metal by a carrier gas via a lance immersed in said molten hot metal; said desulfurization reagent comprising powdered magnesium nitride.

2. A process for desulfuring molten steel comprising: injecting a desulfurization reagent into the molten steel by a carrier gas via a lance immersed in said molten steel; said desulfurization reagent comprising powdered magnesium nitride.

3. A process for desulfuring molten metal comprising: injecting a desulfurization reagent into the molten hot metal by a carrier gas via a lance immersed in said molten hot metal; said desulfurization reagent comprising magnesium nitride.

4. The process of claim 3 wherein said molten hot metal is molten steel.

5. The process of claim 3 wherein said desulfurization reagent is a particulate magnesium nitride.

6. The process of claim 5 wherein said molten hot metal is molten steel.

* * * * *